United States Patent [19]

Gerken et al.

[11] 4,359,242

[45] Nov. 16, 1982

[54] COLLAPSIBLE BABY WALKER-JUMPER

[75] Inventors: Donald L. Gerken; Donald L. Moore, both of Columbus, Ind.; Stephen M. Degnen, Columbus, Ohio

[73] Assignee: Cosco, Inc., Columbus, Ind.

[21] Appl. No.: 302,305

[22] Filed: Sep. 14, 1981

[51] Int. Cl.[3] ..... A47D 13/04; B62D 7/10

[52] U.S. Cl. ..... 297/5; 280/87.02 W; 280/649

[58] Field of Search ..... 297/5, 6, 136; 280/87.02 R, 87.02 W, 647, 649, 650, 87.05

[56] References Cited

U.S. PATENT DOCUMENTS

| | | | |
|---|---|---|---|
| 517,403 | 3/1894 | Bradish et al. | 297/6 X |
| 1,326,921 | 1/1920 | Dzimitowicz | 297/5 |
| 1,342,518 | 6/1920 | Webber | 280/87.05 |
| 3,145,999 | 8/1964 | Burnham | 297/5 X |
| 4,019,756 | 4/1977 | Ishida | 280/649 |
| 4,045,045 | 8/1977 | Boucher et al. | 297/5 |
| 4,211,426 | 7/1980 | Motloch | 280/87.02 W |
| 4,231,582 | 11/1980 | Moss | 280/87.02 |

*Primary Examiner*—James T. McCall
*Assistant Examiner*—Peter A. Aschenbrenner
*Attorney, Agent, or Firm*—Jenkins, Coffey, Hyland, Badger & Conard

[57] ABSTRACT

A walker-jumper comprises a support member carrying a seat for a child, a base member, and a collapsible and expandable frame connecting the support and base members to allow adjustment so that the feet of the child can contact the ground to propel the walker-jumper. The frame connection to the support and base members is by way of a slidable mount for permitting the members to be expanded to a desired one of several expanded positions so that the distance to the ground may be controlled for different sized children. The frame passes through a mounting member slidably carried below the support member and a lock engages the mounting member to fix the base and support members in the desired expanded position. After being locked in place, the frame is yieldably coupled to the mounting member to allow limited movement of the frame relative to the mounting member, responsive to bouncing movements of a child. The slidable connection between the frame and the base member and the spring coupling the frame to the mounting member are protectively enclosed by plates movable with the frame.

12 Claims, 6 Drawing Figures

COLLAPSIBLE BABY WALKER-JUMPER

The present invention relates to collapsible baby walkers, and more particularly to a collapsible baby walker-jumper.

Numerous different types of children's walkers and jumpers are well known. Some of these walkers and jumpers are collapsible for storage and expandable to several positions so that the distance to the ground from the seat may be controlled for different sized children. For example, U.S. Pat. No. b 4,019,756 discloses a collapsible baby walker and means for locking the walker in a desired one of several expanded positions for children of different sizes. Some walkers have also combined the features of a jumper by resiliently supporting the seat of the walker in an expanded position of the walker. For example, U.S. Pat. No. 4,231,582 discloses a collapsible walker-jumper which, when opened to its expanded position, includes springs in the base portion of the jumper for resiliently supporting the seat above the ground.

So far as is known, a juvenile walker-jumper has not heretofore been developed which allows the seat supporting the child to be adjusted so that the distance to the ground may be controlled for different sized children and which combines therewith means for resiliently supporting the seat in a desired one of several expanded positions so that the walker also serves as a jumper. Further, the spring or springs resiliently supporting the seat have heretofore been located at the base of the unit.

It is therefore one object of the present invention to provide a walker-jumper which is expandable to a desired one of several expanded positions so that the distance between the seat supporting the child and the ground can be controlled for different sized children, and which further resiliently supports the seat above the ground in the desired expanded position so that the walker is also operable as a jumper.

A further object of the present invention is to provide a walker-jumper of the type described above which is easily expanded and automatically locked into one of several expanded positions and which is further quickly unlocked and collapsed for storage.

Another object of the present invention is to provide a walker-jumper in which the mechanism for adjusting and locking the walker-jumper in a desired expanded position and the mechanism for resiliently supporting the seat above the ground in the desired expanded position are both located on the member carrying the seat.

Yet another object of the present invention is to provide a walker-jumper which protectively encloses each spring or opening where a child's finger might be pinched during the movement of the member supporting the seat relative to the base member.

In a preferred embodiment of the present invention, the walker-jumper includes a base member, a support member, a seat carried by the support member, a frame operably connecting the base and support members for permitting the members to be moved to a collapsed position near each other and for permitting the members to be moved to a desired one of several expanded positions with a distance between each other, a slidable block mounting the frame to the support member to allow movement of the frame with respect thereto, elongated openings in the base member for slidably receiving the frame to allow movement of the frame with respect to the base member, means for preventing sliding movement of the block for locking the base and support members in a desired expanded position, and a yieldable spring coupling the frame to the block to allow movement of the frame with respect to the block once the block is locked to fix the base and support members in the desired expanded position. Protective plates are provided in the openings of the base member and movable with the sliding movement of the frame to provide a protective enclosure. A safety plate is also provided in the block and is movable with the frame relative to the block to protectively enclose the spring coupling the block to the frame.

Various features and advantages of the present invention will become apparent in view of the following detailed description of one embodiment thereof, which description should be considered in conjunction with the accompanying drawings in which.

Figure 1:
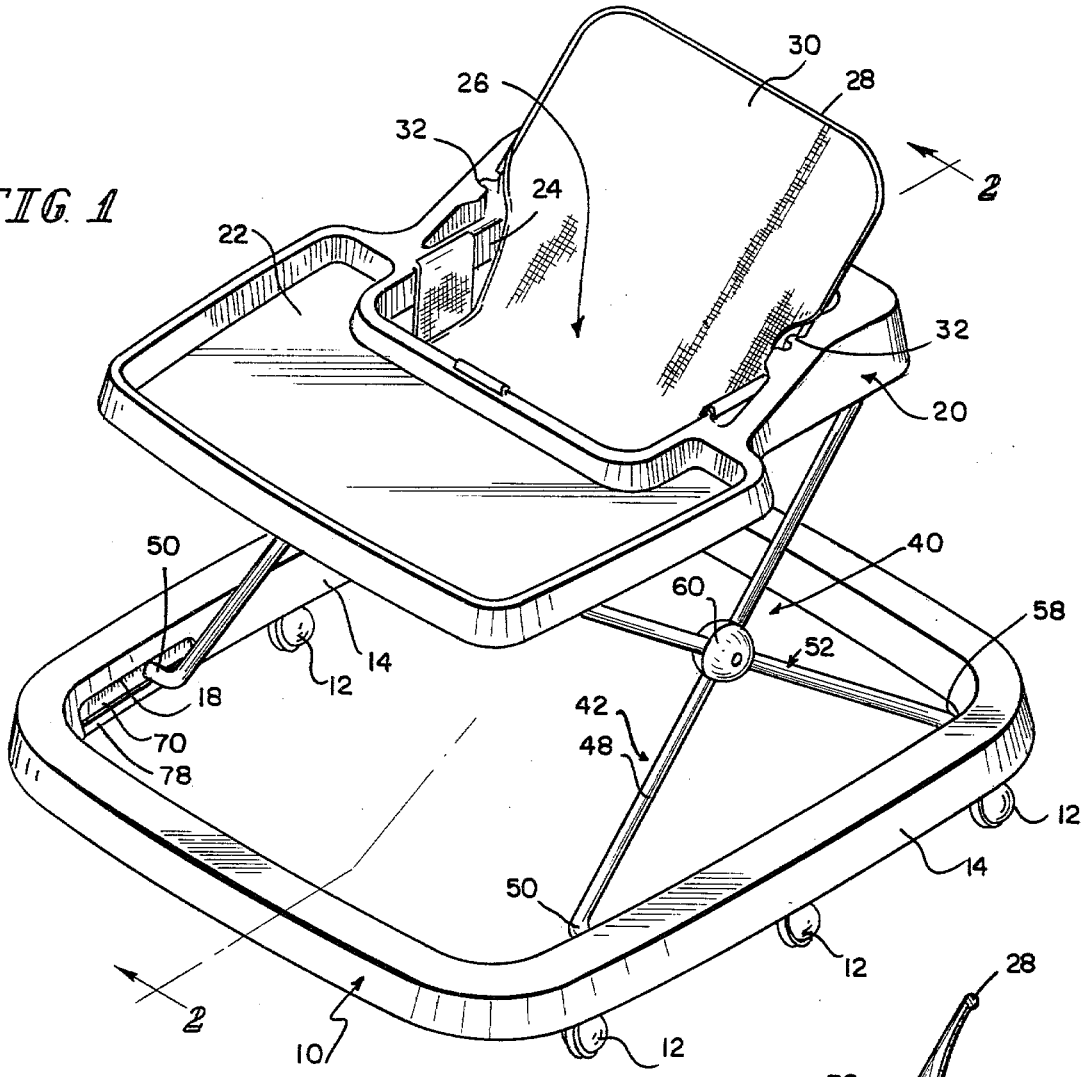
FIG. 1 is a perspective view of a collapsible baby walker-jumper constructed according to the present invention.
Figure 2:
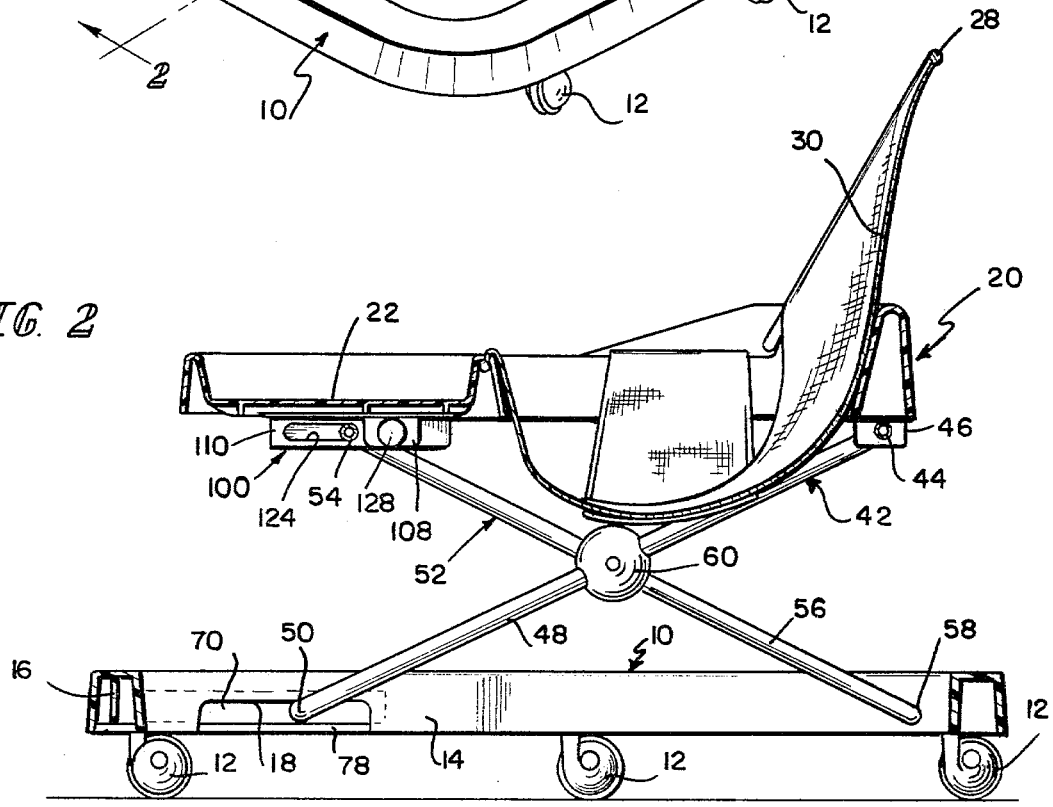
FIG. 2 is a cross-sectional view of the walker-jumper shown in FIG. 1, taken generally along section lines 2—2 of FIG. 1.
Figure 3:
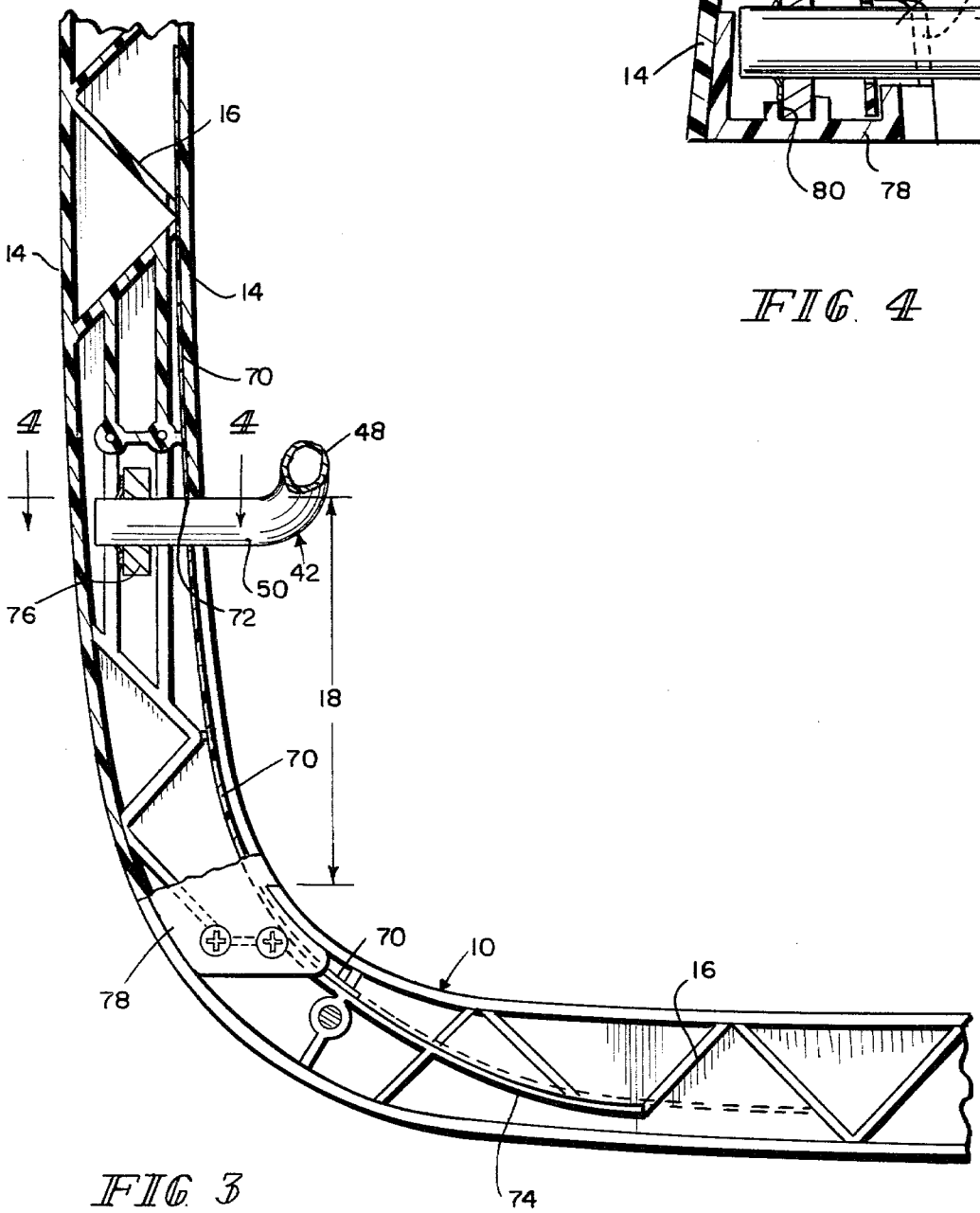
FIG. 3 is a bottom view, looking upward, of the base member of the walker-jumper shown in FIG. 1, partly broken away and cross-sectional, showing the sliding connection between the frame and the proximal corner of the base member in FIG. 1.

Referring now to FIGS. 1 and 2, the baby walker-jumper of the present invention includes an annular base member 10 in the form of a rectangle with rounded corners, provided on its underneath side with a plurality of casters 12 permitting the base member 10 to be rolled along a surface. Side walls 14 of the base member 10 define a cavity within the walls 14 which, as shown in FIG. 3, are reinforced by intersecting ribs 16. Near the front of the base member 10, longitudinal slots 18 are provided in the inner sides of side walls 14.

The walker-jumper further includes a top or support member 20. The support member 20 includes a tray section 22 and an opening 24 rearward of the tray section 22. A seat 26 is suspended in the opening 24 in a manner for supporting a child. A heavy, generally U-shaped wire or tubular member 28 is pivotally connected to the support member 20 to form an adjustable seat back 30, suitably made of canvas or plastic. A series of notches 32 are provided on both sides of the seat 26 for retaining the wire 28 and seat back 30 in a desired inclined position. The inclination of the seat back 30 is adjustable by compressing the wire inwardly so that it clears the notches 32, moving the seat back 30 to a desired inclination, then releasing the wire 28 so that it springs outward into the notches 32 corresponding to the desired inclined position.

The base member 10 and support member 20 are operably connected to each other by a frame 40 for permitting the members 10 and 20 to be moved to a collapsed position near each other and for permitting the members 10 and 20 to be moved through several expanded positions with various distances between each other. The frame 40 includes a first frame section 42. Frame section 42 is generally U-shaped and has a top portion journaled for rotation within mounts 46 secured to the underneath surface of the rear of the support member 10, as shown in FIG. 2. The top portion 44 is rotatable about an axis which is transverse to the longitudinal dimension of the walker-jumper. The first frame section 42 also includes two opposed legs 48 which terminate in lower end portions 50 which project outwardly into the longitudinal slots 18 within the walls 14 of the base member 10. As will be explained in more detail later, the lower end portions 50 of legs 48 are movable longitudinally in the slots 18.

The frame 40 further includes a second frame section 52. The frame section 52 is also generally U-shaped and includes a top portion which is mounted to move longitudinally underneath the surface of the front of the support member 20. Means for mounting the top portion of the frame section 52 to the support member 20 will be described in more detail later. Frame section 52 also includes opposed legs 56 which terminate in lower end portions 58. The lower end portions 58 are journaled for rotation in openings provided in the side walls 14 near the rear of the base member 10.

The first and second frame sections 42 and 52, respectively, intersect on each side of the walker-jumper intermediate their respective top and lower portions 44, 50 and 54,58, respectively. The two frame sections 42 and 52 are connected by two frame connectors 60 which are rotatable so that as the members 10 and 20 are moved relative to each other, the connectors 60 rotate to allow the frame sections 42 and 52 to assume different positions relative to each other.

In the preferred embodiment, the base member 10 and support member 20 are constructed of copolymer polypropylene. The casters 12 are constructed of a high-density polyethylene, and the frame sections and seat back wire 28 are constructed of chrome tubing. It can be appreciated that the various elements of the walker-jumper may be constructed of materials different than those used in the preferred embodiment of the walker-jumper without departing from the scope of the present invention.

Figure 4:
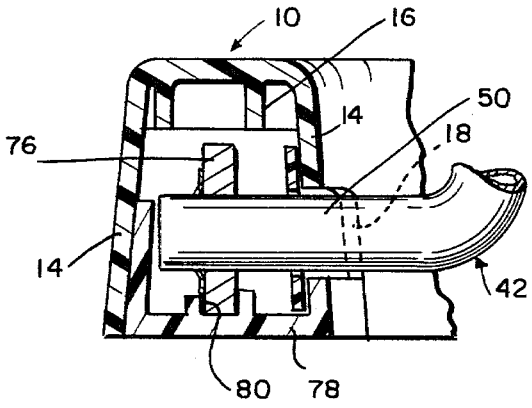
FIG. 4 is a cross-sectional view of the section of the base member shown in FIG. 3, taken generally along section lines 4—4 in FIG. 3.

Referring to FIGS. 3 and 4, a lower end portion 50 of the first frame section 42 is shown passing through one of the longitudinal slots 18 of the base member 10. Two elongated base guard plates 70, each constructed of copolymer polypropylene, are disposed within the cavity formed by the side walls 14 of the base member 10 to cover or close each of the longitudinal slots 18. Each of the guard plates 70 includes a relatively small opening 72 in comparison to the longitudinal slots 18. The lower end portions 50 pass through the openings 72. In response to longitudinal movement of the lower end portions 50 in the slots 18, the guard plates 70 are also moved longitudinally to keep the slots 18 continuously closed. Movement of the guard plates 70 is guided by arcuate rails 74 provided in the cavity formed by the side walls 14 of the base member 10. Guard plates 70 serve to continuously close or cover the slots 18, even during movement of the lower end portions 50 of the first frame section 42, to prevent a child from inserting its finger into the slot 18. This reduces the hazard of pinching children's fingers. Each of the lower end portions 50 of the first frame section 42 is provided with a roller 76 which is positioned within the cavity of the base member 10. As best shown in FIG. 4, a bottom retainer plate 78 is secured to the bottom of the base member 10 to enclose the portion of the cavity housing the lower end portions 50 of the frame section 42. The retainer plates 78 include a roller track 80 for receiving the rollers 76 provided on the lower end portions 50. Rollers 76 serve the dual purpose of fixedly securing the lower end portions 50 in relationship to the slots 18 while permitting the rollers 76 to move along the retainer plate 78 in the roller tracks 80.

Figure 5:
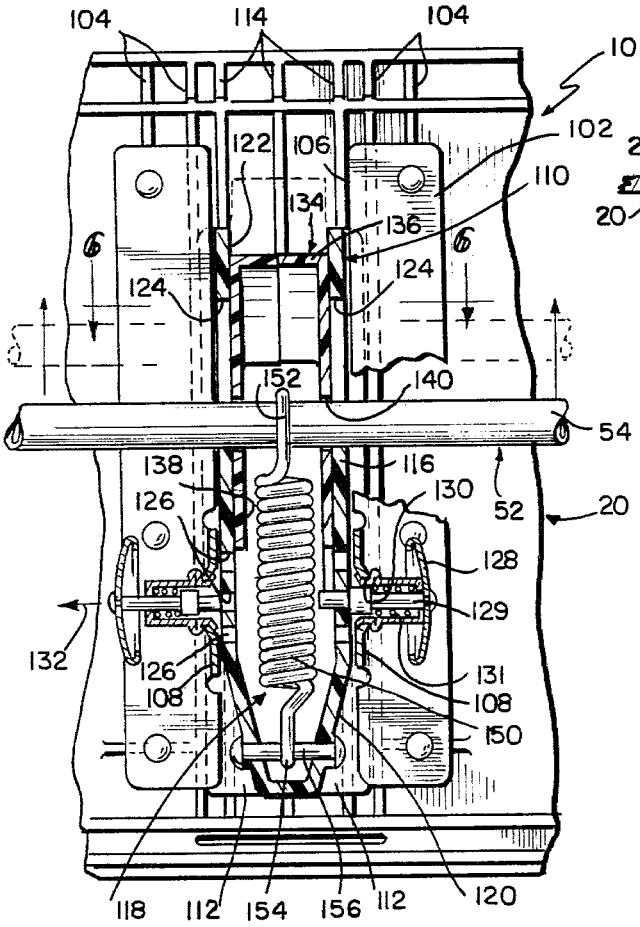
FIG. 5 is an enlarged fragmentary view, partly broken away and cross-sectioned, looking upward, of the adjustment and resilient mechanism 100 (FIG. 2) of the walker-jumper shown in FIG. 1.
Figure 6:
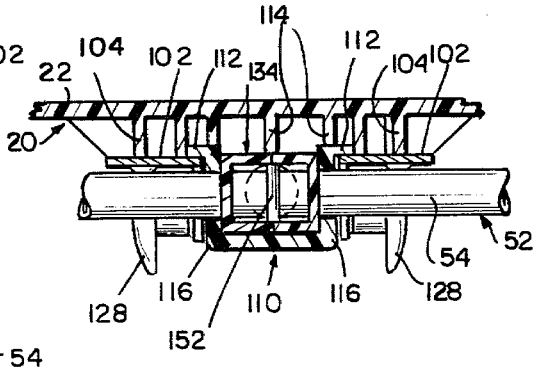
FIG. 6 is a cross-sectional view of the mechanism shown in FIG. 5, taken generally along section lines 6—6 in FIG. 5.

Referring to FIGS. 5 and 6, means 100 for mounting the top portion 54 of the second frame section 52 underneath the front of the support member 20 includes two elongated gibs 102 secured to ribs 104 provided on the underneath surface of the tray section 22 of the support member 20. The gibs 102 extend longitudinally in opposed spaced parallel relationship to define a slideway 106. Each of the gibs 102 includes a downwardly depending wall section 108 which is positioned opposite the other.

An elongated block 110 is slidably received in the slideway 106 defined by gibs 102. Block 110 includes outwardly depending flanges 112 which, as best shown in FIG. 6, are retained between the gibs and shorter ribs 114 provided on the underneath surface of the tray section 22 of the support member 20. The block 110 also includes side walls 116 which define a cavity 118. Side walls 116 form a tapered end 120 which is closed and an open end 122. Elongated longitudinal slots 124 are provided in the side walls 116 of the block 110. The top portion 54 of the second frame secton 52 passes through the slots 124 and is rotatable about an axis transverse to the longitudinal dimension of the walker-jumper. As illustrated by the broken line in FIG. 5, the top portion 54 is movable in the slots 124 from a position toward the rear of the support member 20, represented by the solid lines, to positions toward the front of the support member 20 in the direction of the arrows, as represented by the broken lines, and vice versa. Each of the side walls 116 of the block 110 also include a series of three equally spaced apertures 126 which, as will be explained, are employed for locking the base member and support member 10 and 20, respectively, in a desired one of several expanded positions with a distance between each other.

Two spring-loaded knobs 128 are secured to the downwardly depending walls 108 of the gibs 102. Each of the knobs 128 includes a post 129 which is yieldably urged inwardly through an opening 130 provided in wall 108 by a spring 131 into engagement with the block 110. When an aperture 126 in the side walls 116 of the block 110 is aligned with the posts 129 of the knobs 128, the posts 129 are urged inwardly through the apertures 126 to lock the block 110 in a fixed position relative to the gibs 102. For illustrative purposes, one of the spring-loaded knobs 128 is shown in FIG. 5 projecting through an aperture 126 in one of the walls 116 of the block 110. The other knob 128 is shown retracted from the apertures 126. By grasping the knob and pulling in the direction of the arrow 132 in FIG. 6, the post 126 is retracted to allow the block 110 to slide longitudinally in the slideway 106.

Continuing to refer to FIGS. 5 and 6, a safety plate 134 is disposed within the cavity defined by the side walls 116 of block 110 to close or cover the slots 124 provided in the side walls 116. Safety plate 134 is generally U-shaped having a closed end 136 which projects longitudinally through the open end 122 of block 110 and an open end 138 which opens inwardly into the cavity defined by the walls 116 of block 110. Plate 134 includes openings 140 on opposed sides thereof for receiving the top portion 54 of the second frame section 52. It can be appreciated that plate 134 reduces the hazard of pinching a child's finger in the slots 124 by continuously covering or closing the slots 124, even when the top portion 54 is moved in the slots 124.

Bouncing capability of the walker-jumper is provided by a spring 150 which yieldably couples the top portion 54 of the second frame section 52 to the block 110. Spring 150 gives the walker-jumper its resiliency, and is mounted within the cavity 118 of the block 110. One end 152 of the spring 150 is coupled to the top portion 54 of the second frame section 52, and the other end 154 of the spring 150 is coupled to a pin 156 secured to the block 110. Spring 150 normally urges the top portion 54 toward the rear of the support member 20 in the slots 124. When a downward force is exerted on the support member 20, such as, for example, by a child bouncing in the seat 26 suspended by the support member 20, the spring 150 yields to allow longitudinal movement of the top portion 54 in the slots 124. At the same time that the top portion 54 moves longitudinally in slots 124, the lower end portions 50 of the first frame section 42 move longitudinally in the slots 18 provided in the side walls of the base member 10. As the downward force on the support member 20 is decreased, spring 150 urges the top portion 54 toward the rear of the support member, causing a corresponding longitudinal movement of the lower end portions 50 in the slots 18.

Operation of the walker-jumper can best be described by referring to all of the figures in combination. In its collapsed position, with the base member and support member 10 and 20, respectively, near each other, block 110 is slid toward the front of the support member 20 and the lower end portions 50 are slid forward in the slots 18. Pulling upward on the support member 20 causes the block 110 to slide rearwardly in the slideway 106 and causes the lower end portions 50 to move rearwardly in the slots 18. The support member 20 may be moved through several expanded positions until a desired distance between the members 10 and 20 is determined. It can be appreciated that the distance between the members 10 and 20 will be determined by the size of the child to be placed in the seat 26. The distance between the members 10 and 20 will allow the child to move its feet along the ground to propel the walker-jumper along the ground. At the desired expanded position, spring-loaded knobs 128 are projected through apertures 126 provided in the walls 116 of block 110 to lock the support member 20 in the desired expanded position. Apertures 126 and the spring-loaded knobs 128 coact to define a series of several expanded positions between a fully collapsed position and a fully raised position of the support member 20.

Once the support member 20 is locked in a desired expanded position, vertical bouncing movements of the child in the seat 26 are resiliently opposed by the spring 150. However, spring 150 yields to allow movement of the top portion 54 in slots 124, and the lower end portions 50 are movable in the slots 18 to provide resiliency for the seat 26 in response to vertical bouncing movements of the child.

From the above description, it can be appreciated that the means for adjusting the height of the support member 20 to a desired expanded position relative to the base member 10 and means providing resiliency for the seat 26 in response to vertical bouncing movement of the child are combined in a single mechanism which is mounted on a bottom surface beneath the support member 20. The adjustment mechanism includes means slidable longitudinally for permitting the support member 20 to be moved to a desired expanded position and locked in such position and means yieldably coupling the second frame section to the adjustment mechanism for permitting movement of the second frame section 52 relative to the adjustment mechanism to provide resiliency for the seat 26 in response to vertical bouncing movement of the child.

What is claimed is:

1. A walker-jumper comprising a base member, a support member, a seat carried by the support member, a frame operably connecting the base and support members, coupling means between the frame and the members for permitting the members to be moved to a collapsed position near each other and for permitting the members to be moved through several expanded positions with various distances between each other, means on the support member for engaging the coupling means to lock the members in a desired one of the several expanded positions, and resilient means connecting a first portion of the frame to the coupling means beneath the support member for permitting the support member to move in response to weight on the seat when the members are located in the desired expanded position.

2. The walker-jumper of claim 1 wherein the coupling means includes means mounted beneath the support member defining a slideway and a block slidable longitudinally in the slideway, the block including a longitudinal slot and the first portion of the frame passing through the slot in the block.

3. The walker-jumper of claim 2 wherein the coupling means further includes a longitudinal slot in the base member, a second portion of the frame passing through the slot in the base member.

4. The walker-jumper of claim 3 wherein the block includes a plurality of spaced-apart openings and the engaging means includes a post and means for yieldably urging the post into engagement with the openings as the block slides longitudinally in the slideway to releasably secure the block to the support member.

5. The walker-jumper of claim 4 wherein the resilient means includes a spring connected between the block and the first portion of the frame for resiliently permitting the frame to longitudinally slide in the slot when the block is releasably secured to the support member.

6. The walker-jumper of claim 5 wherein the block includes side walls defining a cavity having a closed end and an open end, the spring being retained within the cavity of the block.

7. The walker-jumper of claim 6 further comprising first means carried on the first portion of the frame for continuously closing the slot in the block to prevent access to the cavity through the slot, the closing means being moved longitudinally in response to longitudinal movement of the first portion of the frame in the slot to continuously close the slot.

8. The walker-jumper of claim 7 wherein the first closing means is disposed within the cavity of the block and includes a wall for closing the open end of the block.

9. The walker-jumper of claim 8 further comprising second means carried on the second portion of the frame for continuously closing the slot in the base member, the closing means being moved longitudinally in response to longitudinal movement of the second portion of the frame in the slot to continuously close the slot.

10. The walker-jumper of claim 9 wherein the second closing means includes an elongated strip and means on the base member for guiding the movement of the strip.

11. In a walker comprising a base member, a support member, a seat carried by the support member, a frame operably connecting the base and support members for permitting the members to be moved to a collapsed position near each other and for permitting the members to be moved to a desired one of several expanded positions with a distance therebetween, slidable means mounting the frame to one of the base and support members to allow movement of the frame with respect thereto, and means preventing sliding movement of the mounting means for locking the base and support members in a desired expanded position, the improvement comprising means yieldably coupling the frame to the mounting means to allow movement of the frame with respect to the mounting means once the base and support members are locked in the desired one of the expanded positions, the frame being moved in opposition to the yieldable coupling means in response to a downward force on the support member to allow movement of the support member toward the base member.

12. A walker-jumper comprising a support member, a seat carried by the support member, a base member, a frame operably connecting the support and base members for permitting the members to be moved to a collapsed position near each other and for permitting the members to be moved to a desired one of a plurality of expanded positions with a distance therebetween, the frame including first and second sections having top portions, bottom portions, and intermediate portions between the top and bottom portions intersecting each other, means rotatably mounting the top portion of the first frame section to the support member, means slidably mounting the bottom portion of the first frame section to the base member, means slidably mounting the top portion of the second frame section to the support member, means rotatably mounting the bottom portion of the second frame section to the base member, the means slidably mounting the top portion of the second frame section to the support member including means providing a slideway beneath the support member, a block mounted to slide longitudinally in the slideway, the top portion of the second frame section passing transversely through the block, means yieldably engaging the block to prohibit sliding in the slideway and to lock the support and base member in the desired one of the expanded positions, the block including elongated slots to allow longitudinal movement of the top portion of the second frame section relative to the block, and means yieldably urging the top portion of the second frame section toward one end of the slot, the top portion of the second frame section being movable in the slots in opposition to the urging means, and the bottom portion of the first frame section being slidable relative to the base member in response to a downward force exerted on the support member when the support and base members are locked in the desired one of the expanded positions.

* * * * *